United States Patent [19]

Shima et al.

[11] Patent Number: 4,488,416

[45] Date of Patent: Dec. 18, 1984

[54] SET-UP MEANS IN A FLAT KNITTING MACHINE

[75] Inventors: Masahiro Shima; Hirozi Nishida, both of Wakayama, Japan

[73] Assignee: Shima Idea Center Co. Ltd., Wakayama, Japan

[21] Appl. No.: 481,260

[22] Filed: Apr. 1, 1983

[30] Foreign Application Priority Data

Apr. 15, 1982 [JP] Japan ..... 57-62982

[51] Int. Cl.[3] ..... D04B 15/88

[52] U.S. Cl. ..... 66/149 R

[58] Field of Search ..... 66/149 R, 150, 152

[56] References Cited

U.S. PATENT DOCUMENTS

| | | | |
|---|---|---|---|
| 3,250,094 | 5/1966 | Monk | 66/149 R |
| 3,618,343 | 11/1971 | Essig | 66/150 |
| 3,633,386 | 1/1972 | Bruelemans | 66/149 R |
| 3,651,699 | 3/1972 | Findewirth | 66/149 R |

FOREIGN PATENT DOCUMENTS

| | | | |
|---|---|---|---|
| 1635961 | 3/1971 | Fed. Rep. of Germany | 66/149 R |
| 690167 | 4/1953 | United Kingdom . | |
| 991975 | 5/1965 | United Kingdom . | |
| 1014623 | 12/1965 | United Kingdom . | |
| 1254540 | 11/1971 | United Kingdom . | |
| 1285821 | 8/1972 | United Kingdom . | |

*Primary Examiner*—Ronald Feldbaum

[57] ABSTRACT

In a V-bed flat knitting machine, a set-up comb having a plurality of teeth which are hook shaped at their upper ends is up and down movably disposed beneath a gap between a pair of needle beds. When the set-up comb is elevated until the tooth ends thereof extend above the gap, the hooks at the tooth ends hook up loops to form a set-up course. If released at this stage, the comb is allowed to lower by its own weight the set-up course end of the fabric being knitted as knitting progresses while giving adequate tension to the fabric. There is provided a knockover plate such that when the set-up comb is lowered to a predetermined position the plate may push the hook-engaged fabric at a portion adjacent the lower end thereof and from the back side of the hooks. If the set-up comb is slightly elevated or the knockover plate is slightly lowered while the fabric is so pushed, then the set-up course is disengaged from the hooks.

5 Claims, 17 Drawing Figures

4
4a
4b
5
6
10
11
IV 2f
2r
50
8
17
18
34
31
30
32
36
19
29
21
40
4a
30a
20
39
4
37
22
38
41
4b
9
42
25
26
6
23
24
43

SET-UP MEANS IN A FLAT KNITTING MACHINE

BACKGROUND OF THE INVENTION

The present invention relates to set-up means in a flat knitting machine.

Flat knitting machines have an advantage that they permit widening and narrowing operation, so that fabrics can be fashioned as desired. However, when fashioning is carried out on a batch basis, knitting operation involves the following problem at set-up stage.

If the final-course width of a fashioned fabric is smaller than that of the set-up course, for example, it is necessary that a large number of waste courses should be provided betseen the final course of the knitted fabric and the set-up course of the next batch fabric in such a way that the waste courses are sequentially widened until the set-up course width of the next batch fabric is reached. Otherwise, the set-up course of the next batch fabric will be subject to partial stretch and no widthwise uniformity can be obtained in knit construction.

SUMMARY OF THE INVENTION

It is a primary object of the present invention to provide set-up means which permit fashioning of knitted fabrics without involving above said problem, even if such batch-basis fashioning is repeatedly carried out, with provision of fewer waste courses.

In the case where the knit width of the final course is larger than or equal to that of the set-up course, the set-up means according to the invention permit smooth and efficient knitting operation with respect to such fabric. In essence, the present invention consists in: set-up means in a flat knitting machine having a pair of needle beds arranged in an inverted V shape, comprising a set-up comb having a plurality of tooth members, each shaped like a hook at the upper end thereof, said set-up comb being up and down movably disposed beneath a gap between the needle beds in such a way that the upper ends of said tooth members extend beyond said gap when the set-up comb is elevated to the upper extreme, drive means for up-and-down movement of said set-up comb, a knockover plate disposed under the needle beds and supported between side frames of the machine and on the back side of said tooth-end hooks of the set-up comb, said knockover plate having an operative portion displaceable between a retreated position at which said plate will not interfere with the up-and-down movement of the set-up comb and an advanced position at which said plate is able to press the knitted fabric engaged by the set-up comb at its lowered position from the back side of the tooth-end hooks of said comb, drive means for displacing said displaceable portion of the knockover plate, and drive means for displacing said tooth ends of the set-up comb slightly upwardly relative to said displaceable portion of the knockover plate at the advanced position thereof, said drive means being connected to either the set-up comb or the knockover plate.

The above and other related objects and features of the invention will be apparent from the following description and claims taken in connection with the accompanying drawings, forming a part of this application.

DESCRIPTION OF THE PREFERRED EMBODIMENTS

Figure 1:
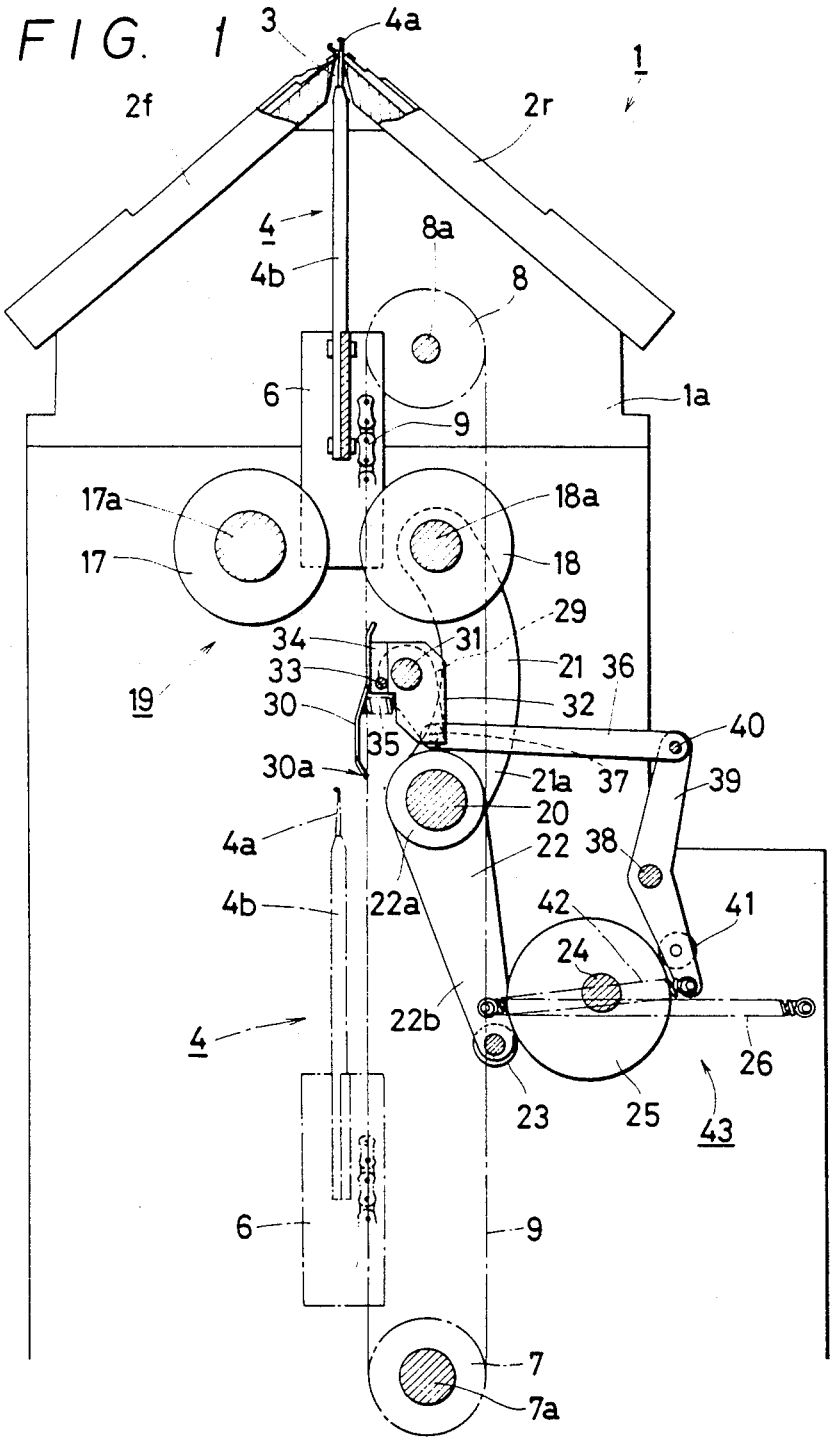
FIG. 1 is a vertical section in side elevation of a flat knitting machine showing one form of set-up means embodying the present invention.
Figures 2, 3, 4:
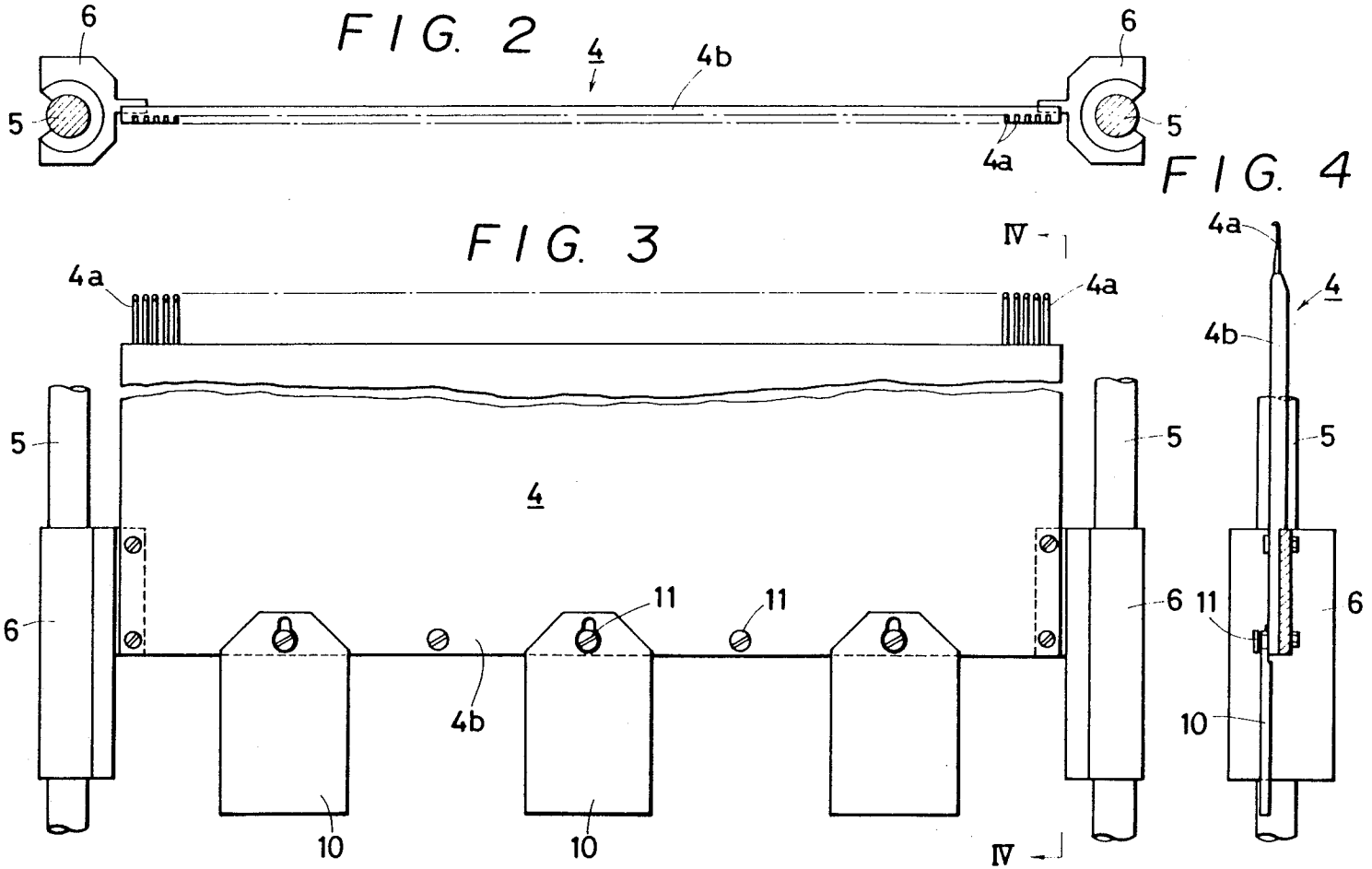
FIG. 2 is a plan view of a set-up comb.
FIG. 3 is a front fiew thereof.
FIG. 4 is a side view thereof.

Referring to FIGS. 1 to 10, inclusive, which show one embodiment of the invention, a set-up comb 4 has a plurality of tooth members 4*a* arranged on a base plate 4*b*, each tooth member having a forward-facing hook-shaped portion at its upper end. The set-up comb 4 is up and down movably disposed beneath a gap 3 between a pair of needle beds 2*f*, 2*r*. The set-up comb 4 of this embodiment has its lower end portion fixed at both sides thereof to sliding blocks 6,6 which are in slide engagement with a pair of upwardly extending rails 5,5 fixed to side frames 1*a* of a flat knitting machine 1 and is up and down movable between an elevated position (shown by solid line in FIG. 1) at which the upper ends of the tooth members 4*a* extend above the gap 3 and a lowered position (shown by chain line in FIG. 1) at which said upper ends are positioned at a level lower than the position of a knockover plate 30 to be described hereinafter. To the sliding blocks 6 there is connected a chain 9 trained over a pair of sprocket wheels 7,8 disposed beneath the needle bed 2*r* in vertically spaced apart relation and rotatably supported at 7*a*, 8*a* between the side frames 1*a*. The shaft 7*a* of the lower sprocket wheel 7 is connected to a reversible drive source not shown, so that by rotating the shaft 7*a* forwardly or reversely the set-up comb 4 can be displaced upwardly or reversely between the elevated and lowered positions as shown in FIG. 1. In the driving system of said shaft 7*a* there are provided clutch and brake means not shown, and therefore, the set-up comb 4 may be locked at the elevated position or lowered position as required, or may be allowed to move downward from the elevated position by its own weight (to give hold-down tension). For this latter purpose, the base plate 4*b* is provided with pins 11 by which holding-down weights 10 may be removably attached.

Figure 5:
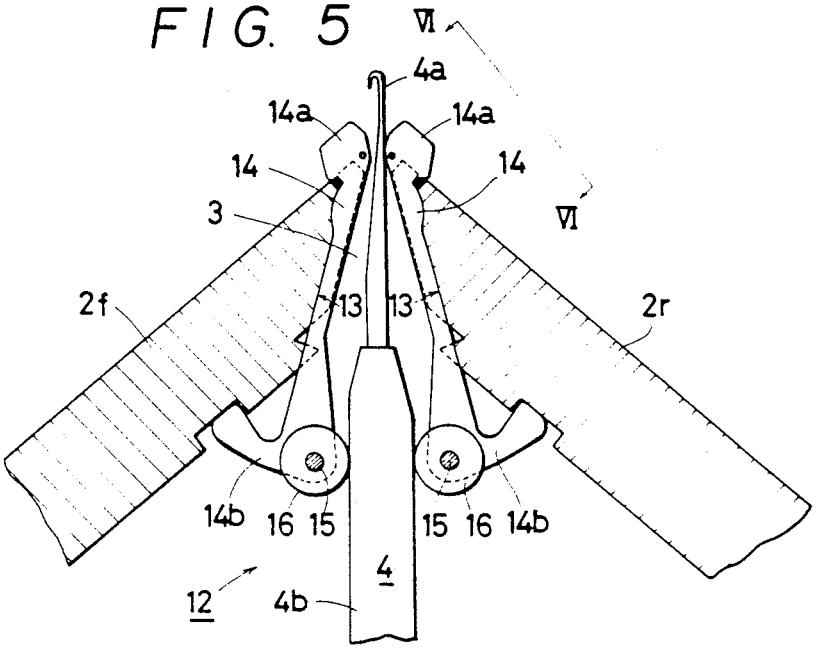
FIG. 5 is a vertical sectional side view of needle beds illustrating guide means for the set-up comb.
Figure 6:
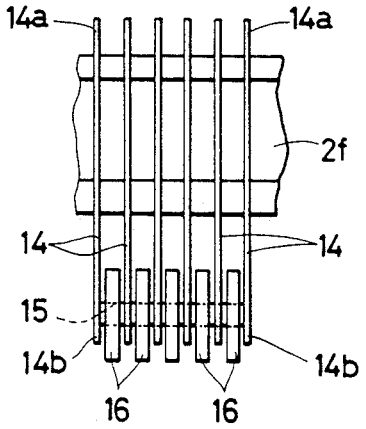
FIG. 6 is a sectional view taken on the line VI—VI in FIG. V showing a part of one of the needle beds.
Figure 7:
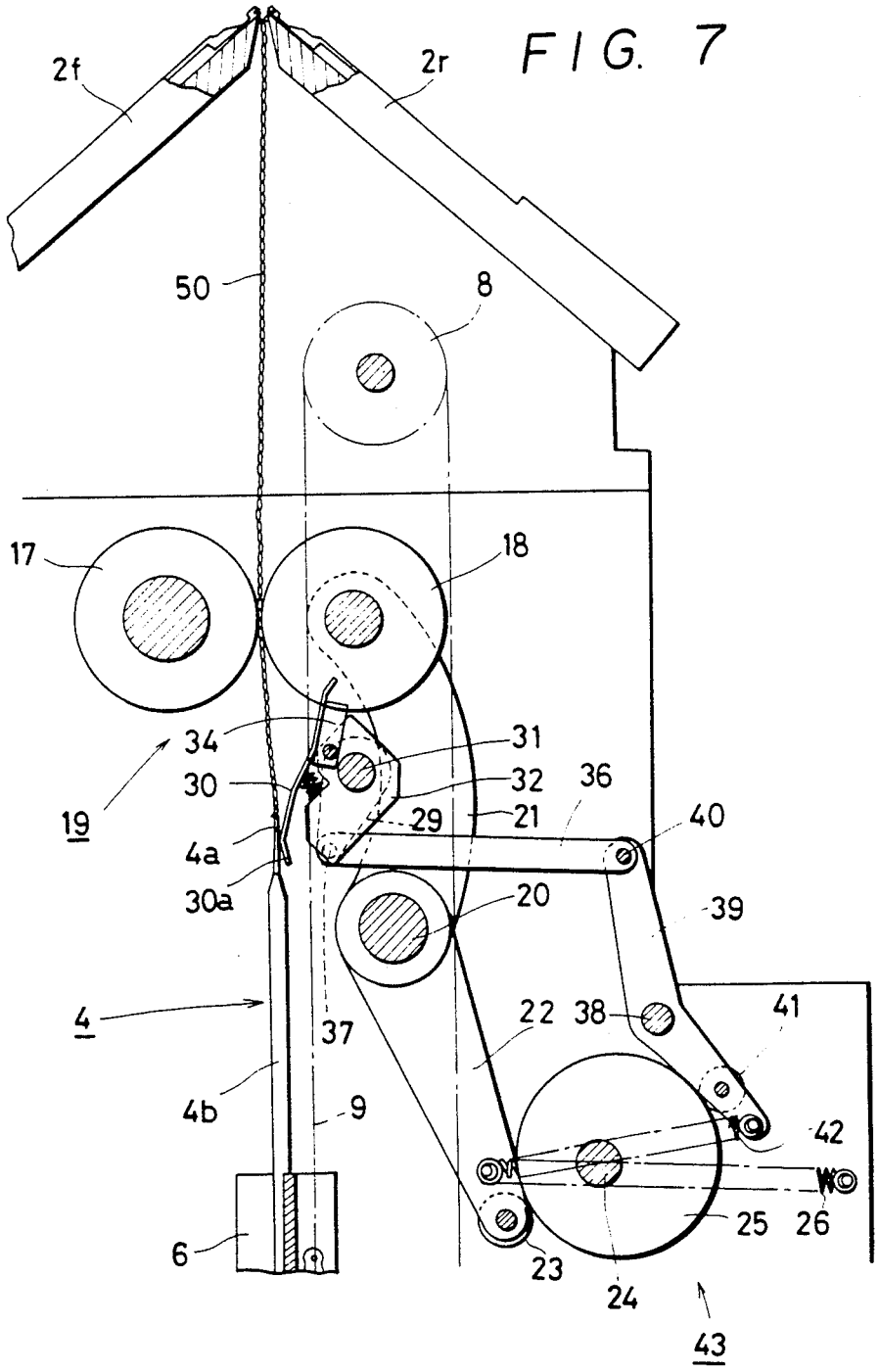
FIGS. 7 to 10, inclusive, are side views showing key parts of the set-up means, with exploded illustration of knock-over operation.
Figure 8:
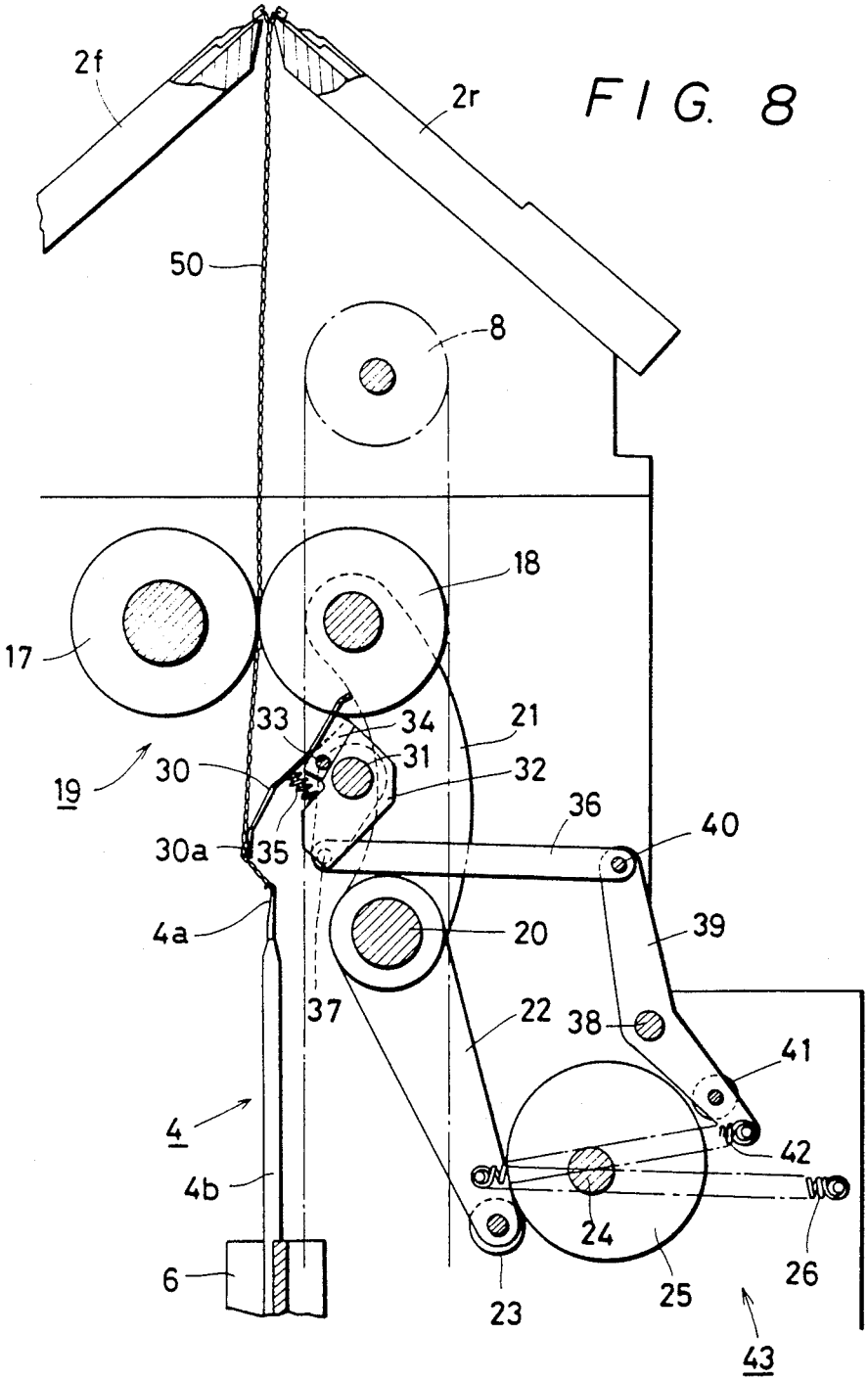
Figure 9:
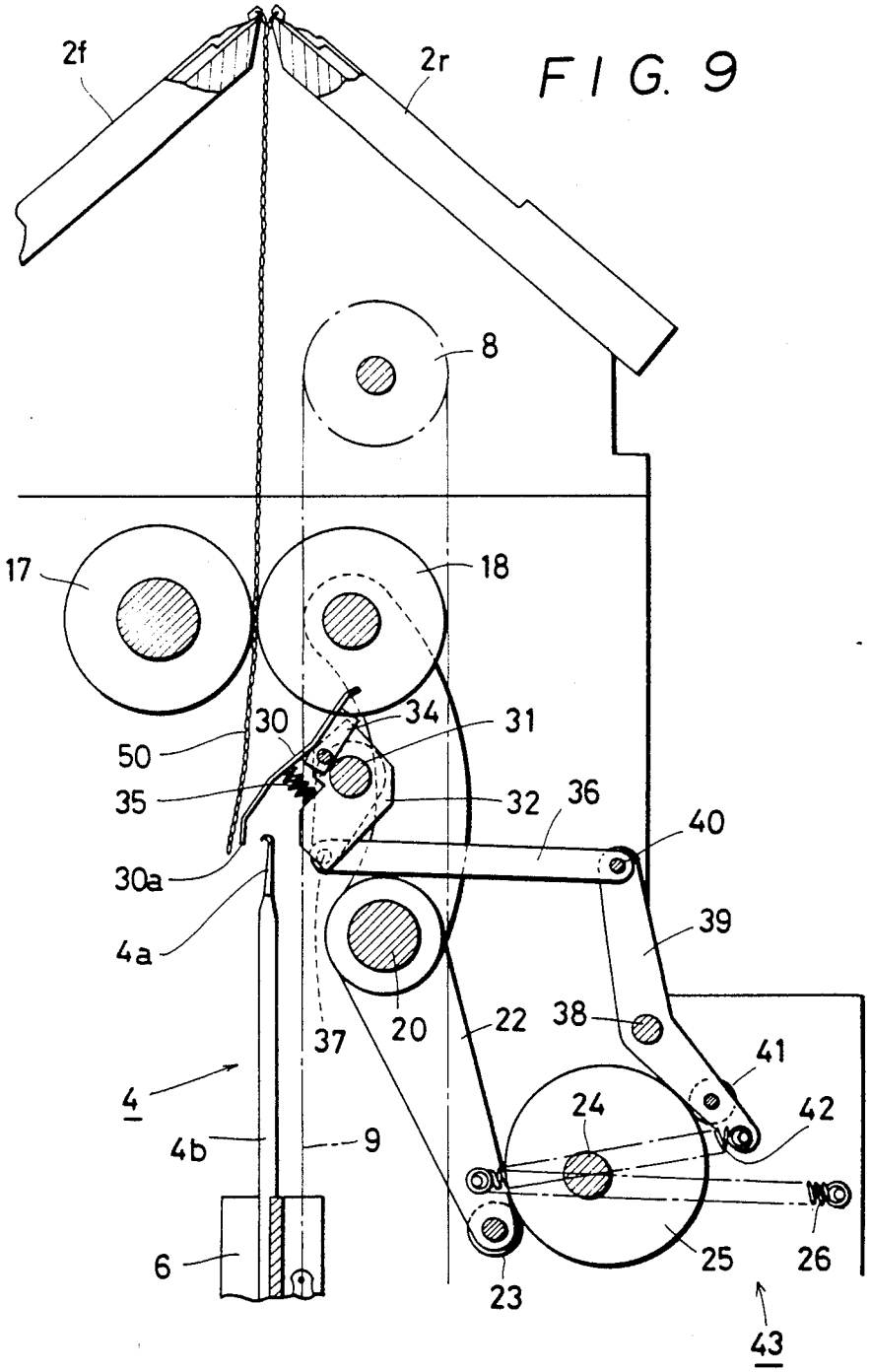
Figure 10:
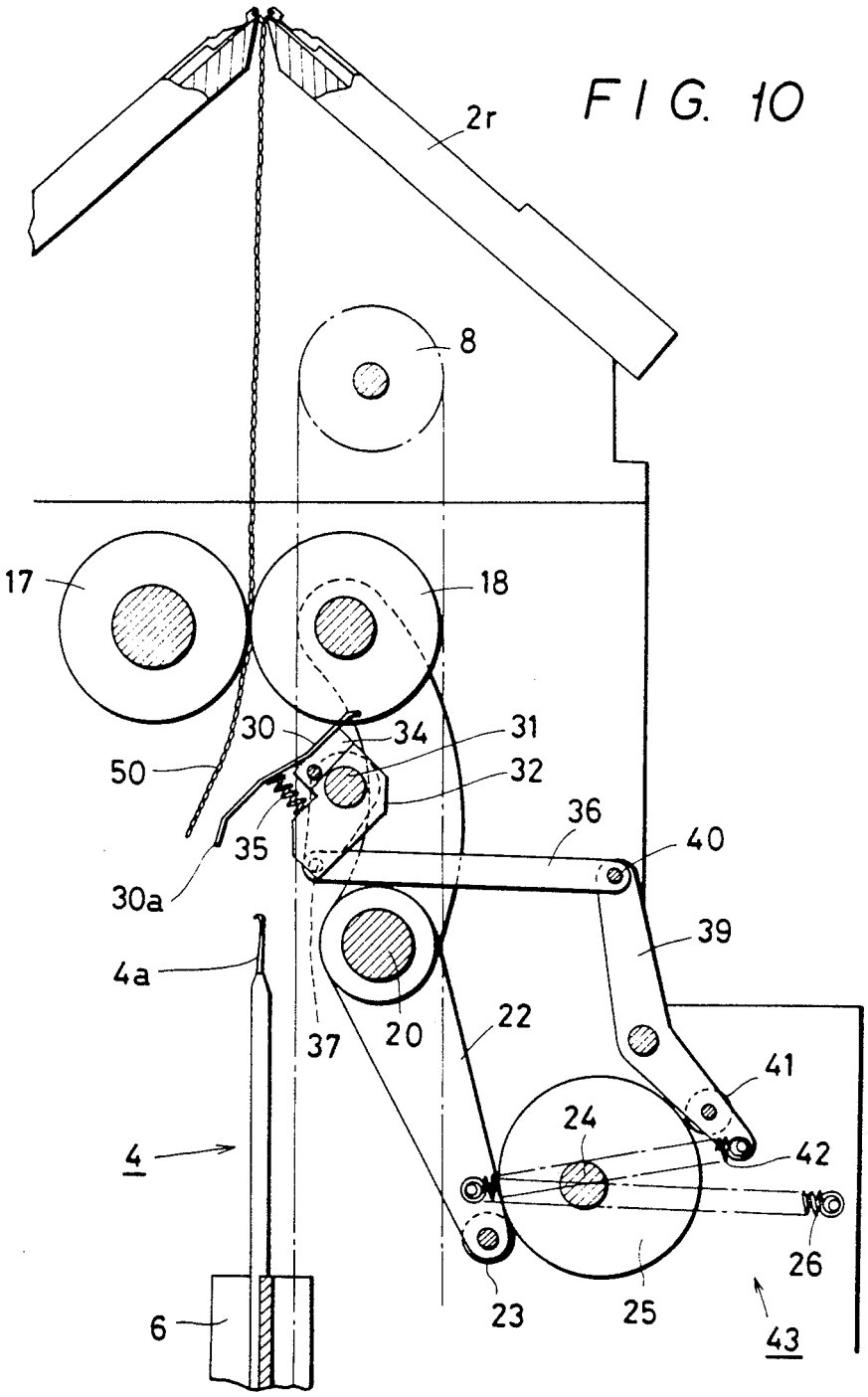

In order to prevent the hook portion of the tooth members 4*a* from striking or scratching the needle beds 2*f*, 2*r* during up-and-down movement of the set-up comb, it is desirable that in the set-up means of the invention there should be provided guide means 12 for supporting and guiding the upper portions of the set-up comb 4 to ensure their smooth passage through the gap 3 without deviation from the track. In the present embodiment, as FIGS. 5 and 6 illustrate, the guide means 12 comprise extensions 14*b* to the lower ends of a plurality of knockover-comb plate menbers 14 fixed to each of the needle beds 2*f*, 2*r* along a plurality of parallel grooves 13 formed thereon, the upper end portions 14*a* of which plate members 14 constitute a knockover comb, said extensions 14*b* extending to the underside of the needle beds 2*f*, 2*r*, a pin 15 extending through each set of said knockover-comb plate members 14 via holes bored through said plate members 14 at the lower ends 14*b* thereof, and a plurality of rollers 16 rotatably arranged on said pin between the individual knockover-comb plate members. Accordingly, when the upper ends of tooth members 4*a* of the set-up comb pass through the narrowest portion of the gap 3, the sets of rollers 16 serve as a positive guide for their smooth passage while holding the upper portion of base plate 4*b* of the set-up comb 4 in position from both sides, so that the tooth members 4*a* may be allowed to perform their up-and-down movement maintaining their proper travel position and without forward or backward deflection within the gap 3.

The knitting machine 1 in the present instance has fabric take-up means 19 arranged beneath the gap 3, which means comprise a combination of a take-up roller 17 and a counter roller 18 disposed in opposed relation thereto. This requires some arrangement which will allow the set-up comb 4 to pass between said rollers 17 and 18 during its up and down movement. For this purpose, there is provided an open-close control mechanism for changing the distance beween said rollers 17 and 18, which mechanism is arranged as follows.

The take-up roller 17 is mounted on a drive shaft 17*a* extending between the side frames 1*a*, 1*a* of the machine and bearing-supported in position. The counter roller 18 is rotatably supported on a shaft 18*a* between the free ends of a pair of arms 21 which are fitted at their base ends 21*a* over a shaft 20 extending between the side frames 1*a*, 1*a* and bearing-supported in position and which are pivotally supported at said base ends 21*a* on said shaft 20. Thus, the counter roller 18 is movable toward and away from the take-up roller 17. For this purpose, there is provided a lever 22 having its base end 22*a* fitted over said shaft 20. At the free end 22*b* of the lever 22 there is provided a roller 23 supported on a shaft. For rolling contact with the roller 23 there is provided an eccentric circular cam 25 rotatably supported on the side frame 1*a*.

Therefore, if the eccentric circular cam 25 is actuated to depress the force of spring means 26 urging the counter roller 18 to be pressed against the take-up roller 17, the counter roller 18 is caused to move away from the take-up roller 17 until a desired distance (as shown in FIG. 1) is reached therebetween, so that the set-up comb 4 may be allowed to move up and down smoothly between said rollers 17 and 18. The arrangement is such that each half turn of the eccentric circular cam 25 from the phase shown allows the two rollers 17 and 18 to come in close contact or go out of contact.

Referring now to the knockover plate 30 disposed beneath the needle bed 2*r* and drive means thereof, in the present instance it should be borne in mind that the fabric take-up means 19 comprising the take-up roller 17 and the counter roller 18 opposed thereto are disposed beneath the gap 3 as discribed above, and therefore, the knockover plate 30 is disposed under the counter roller 18 in the following manner.

In the embodiment shown in FIGS. 1 to 10, inclusive, the knockover plate 30 is fixed to a mounting bracket 34 which constitutes a component of support means for said plate 30. Said support means comprise a shaft 31 rotatably supported between the side frames 1*a*, 1*a* and under the counter roller 18, a block 32 fitted over said shaft 31, and said bracket 34, which is pivotally supported at 33 on said block 32. The knockover plate 30 has an operative portion 30*a* which is constantly urged to move away from the lower free end of the block 32 through spring means 35 disposed suitably between said plate 30 and the block 32, the displacement of said operative portion 30*a* under such urging force being limited so that the operative portion 30*a* is brought to stop at a predetermined position as the upper-end-side back surface of the knockover plate 30 strikes the upper portion of the block 32 at a level above the pivot point 33 for the bracket 34. To the shaft 31 there is fixed a lever 29 at the base thereof. A link 36 is connected at its one end 37 to the free and of the lever 29. The other end of the link 36 is connected at 40 to one end of a lever 39 pivotally supported at 38 on the side frame 1*a*. Adjacent the other end of the lever 39 there is rotatably supported a roller 41, which is in rolling pressure contact with said eccentric circular cam 25 at a position that is 180 different in phase from the position of said roller 23, under the force of spring means 42 connected to the lever 39.

Drive means 43 for the knockover plate 30 are constructed as above described. Therefore, upon each half turn of the eccentric circular cam 25 said block 32 is pivotally displaced so that said operative portion 30*a* of the knockover plate 30 is displaced to an advanced position (shown in FIG. 8) at which the knockover plate 30 may press the knitted fabric 50 engaged by the set-up comb 4 at the lowered position from the back side of said hooks of tooth members 4*a* of said comb 4 or back to a retreated position (shown in FIG. 1) at which the knockover plate 30 does not interfere with up and down movement of the set-up comb 4, as the case may be.

Constructed as above described, the set-up means of the present embodiment may be operated in the following manner. For this purpose it is assumed that there are provided, between the shaft 7*a* of said sprocket wheel 7 and the reversible drive source for the set-up comb 4, automatic control means which will allow a small-range up and down movement of the set-up comb 4 when the comb 4 has reached its lowered position, and at the drive source for the eccentric circular cam 25, automatic control means which will allow half-turn operation of said cam 25 when the comb 4 has reached its lowered position.

To set up a first course of a fabric 50, the eccentric circular cam 25 is held in the phase shown in FIG. 1 to position the knockover plate 30 and counter roller 18 at their respective retreated positions so that they will not interfere with up-and-down movement of the set-up comb 4. The chain 9 is actuated to bring the set-up comb 4 to its most elevated position. Thus, the upper ends of the comb's tooth members 4*a* extend above the gap 3 (as shown by solid line in FIG. 1), and the machine is now ready for knitting the set-up course. When this condition is reached, yarn for the first course is fed to needles and the drive shaft 7*a* for the sprocket wheel 7 is controlled into neutral condition. The set-up comb 4 is then lowered by its own weight. Thereupon, loops of the first course are all hooked up by the hooks at the upper ends of the tooth members 4*a*, and the comb 4 appears to be hanging down from the loops.

As knitting operation progresses, the set-up comb 4 is allowed to go down gradually while hanging down from the fabric 50. After the set-up comb 4 has passed through the gap between the pair of rollers 17, 18 which constitute the take-up means 19, the eccentric curcular cam 25 is driven one-half turn, and the counter roller 18 is displaced forward by the action of the lever 22 having a roller 23 which is in rolling engagement with the cam 25, so that the fabric 50 is held, under pressure of the spring means 26, between the counter roller 18 and the take-up roller 17 and at a level above the tooth members 4*a*. At same time, the lower free end of the block 32 is displaced forward by the action of the lever 39 whose roller 41 is in rolling engagement with the cam 25. Thereupon, the operative portion 30*a* of the knockover plate 30 is pressed against the back of the fabric 50 under the force of the spring means 42 and 35 (FIG. 8), if the ends of the tooth members 4*a* have already been lowered to a level below said operative portion 30*a*. If the ends of the tooth members 4*a* have not been lowered to such level, the operative portion 30*a* is pressed against the back of the tooth members 4 under the force of the spring means 42 and 35 (FIG. 7), and later when said tooth ends are lowered to said level, the operative portion 30*a* is pressed against the back of the fabric 50 as above mentioned. After the displaceable portion 30*a* of the knockover plate 30 is thus displaced forward above the tooth members 4*a* while being allowed to press the back of the fabric 50, the chain 9 is actuated to move the set-up comb 4 slightly upward. When the ends of the tooth members 4*a* are elevated to a level above the lower end of the operative portion 30*a*, the first-course loops of the fabric 50 engaging the tooth members 4*a* are relatively pushed down by said operative portion 30*a* so as to be disengaged from the hooks of the tooth members 4*a*, and thus the loops are cast off from set-up comb 4.

The tooth members 4*a* of the set-up comb 4 so moved slightly upward, if left as they are, may interfere with the retraction of the knockover plate 30, and thus their subsequent elevation to the setting-up position may be prevented. Therefore, after its disengagement from the fabric 50, the set-up comb should be lowered to provide a gap enough to permit the retreat of the knockover plate 30 from said advanced position. For this purpose, it is desirable that the chain 9 should be actuated to move the set-up comb 4 up and down more than one trip during such knocking-over operation.

Where fabric take-up means 19 are provided as in the case of the present embodiment, the fabric 50 released from the set-up comb 4 may be subsequently held down while necessary tension is given by the take-up means 19. If there is no provision of such take-up means, the fabric may be held down by using a known type of sinker or presser. The fabric 50 released from the set-up comb in manner as above described can be released from the needles any time when knitting is completed.

Needless to say, after said knocking-over operation is completed, the knock-over plate 30 and counter roller 18 can be retreated by causing the eccentric circular cam 25 to turn one-half turn, so that the set-up comb 4 can be elevated again to the setting-up position as required.

In the above described embodiment, the arrangement for knock-over operation is such that when the upper ends of tooth members 4*a* of the set-up comb 4 is lowered to a level lower than the position of operative portion 30*a* of the knockover plate 30, said operative portion 30*a* may be displaced forward to press the fabric 50 at a portion adjacent the set-up course and from the back of the fabric, whereupon the set-up comb 4 is slightly elevated so that knocking-over is effected behind the knockover plate 30. According to the arrangement of another embodiment, when the set-up comb 4 and the operative portion 30*a* are in the same position relationship as mentioned above, that is, the former is at lower level than the latter, and the latter is pressing the fabric from behind, knockover operation may be carried out in such a way that the operative portion 30*a* is lowered to a level lower than the position of the upper ends of the tooth members 4*a* and on the front side thereof. In still another embodiment, the arrangement may be such that when the relative positions of the tooth members 4*a* and the operative portion 30*a* of the knockover plate 30 are same as above said, the latter is slightly lowered, and simultaneously the former is slightly elevated, to effect knocking-over (which arrangement is not shown).

Figure 11:
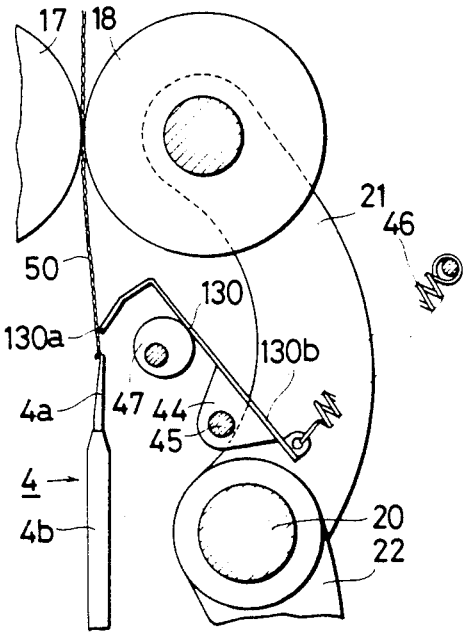
FIGS. 11 to 13, inclusive, are side views of a knock-over plate of another embodiment illustrating mode of knock-over operation in exploded manner.
Figure 12:
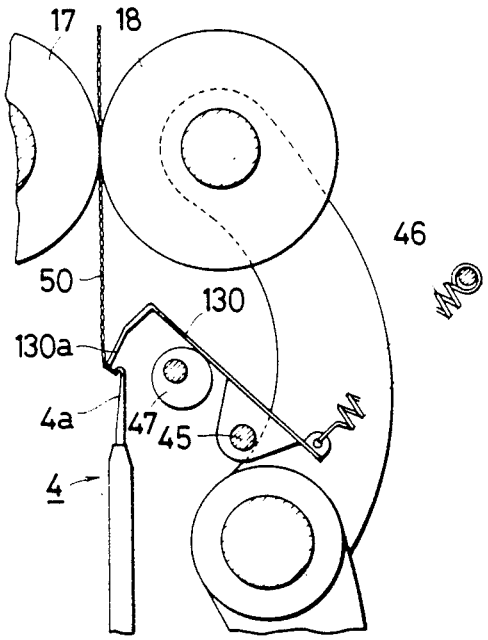
Figure 13:
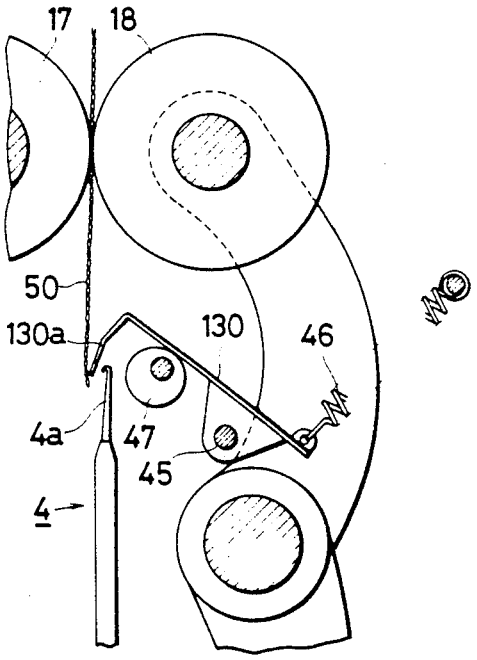
Figure 17:
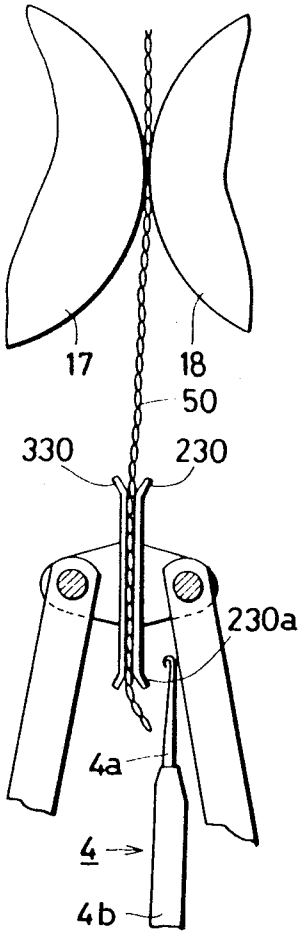
FIGS. 14 to 17, inclusive, are views in side elevation illustrating pattern of knocking-over in exploded manner as seen with a still another embodiment.
Figure 16:
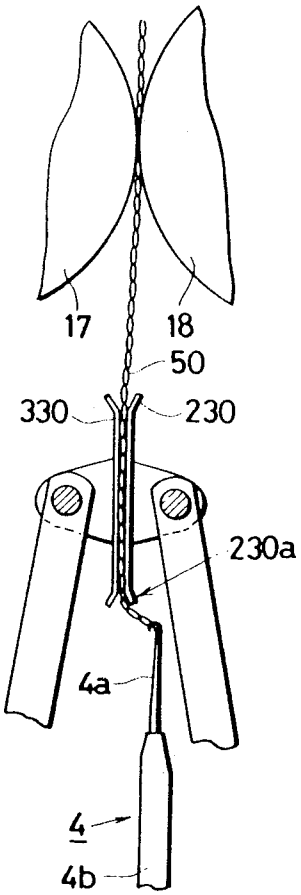
Figure 15:
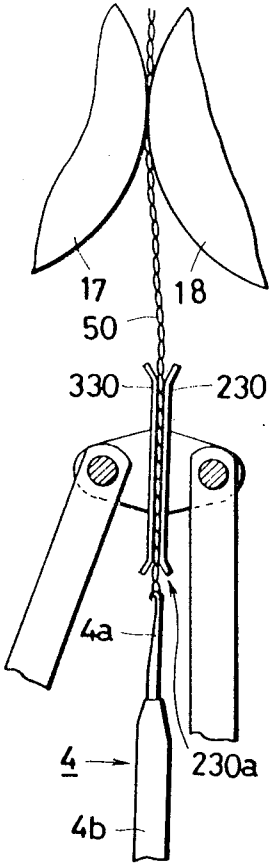
Figure 14:
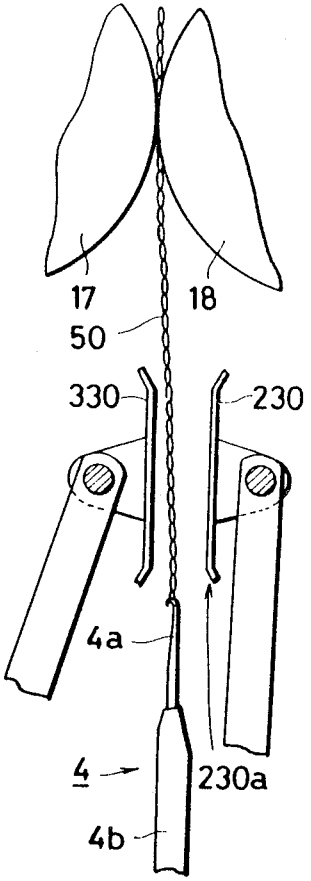

Referring to FIGS. 11 to 13, inclusive, there is illustrated a second preferred embodiment which is somewhat different from the first embodiment in that the knockover plate 30 is lowered, while the tooth-end position of the set-up comb 4 is slightly upwardly changeable relative to the operative portion 30*a* of the knockover plate 30.

The knockover plate 130 in this embodiment is hoe-shaped in longitudinal section and its portion 130*b* corresponding to the handle of the hoe configuration is pivotally supported by a shaft 45 through a bracket 44 to which it is fixed. The shaft 45, supported between the side frames 1*a* of the machine, is disposed on the back side of tooth-end hooks of the set-up comb 4 and at a level lower than the tooth ends of the comb 4. Pivotally supported at 45, the knockover plate 130 is displaceable between a retreated position (FIG. 11) at which its operative portion 130*a* corresponding to the front end portion of the hoe configuration will not interfere with up-and-down movement of the set-up comb 4 and an advanced position (FIGS. 12 and 13) at which said operative portion 130*a* may press the fabric 50 engaged by the set-up comb 4 at its lowered position from the back side of the tooth-end hooks of the comb 4. Drive means for displacing the knockover plate 130 between said two positions and for slightly upwardly changing the tooth-end position of the set-up comb 4 relative to the operative portion 130*a* of the knockover plate 130 at its advanced position there are of pivotal drive type, which comprise spring means 46 connected to the knockover plate 130, and a cam 47 disposed in contact relation with the plate 130 and on the opposite side from the spring means 46. Thus, operation of the knockover plate 130 in this embodiment is carried out in the following way: the operative portion 130*a*, held in the retreated position (FIG. 11), is displaced by being pivoted at 45 when fabric-carrying tooth ends of the set-up comb 4 have gone down passing in front of the operative portion 130*a*; this allows the operative portion 130*a* to press the fabric 50 from the back side thereof (FIGS. 11–13), and upon its front end passing in front of the hooks of the tooth members 4*a*, the first course loops of the fabric 50 are cast off from the hooks (FIG. 13).

In the above described embodiments, the mode of knockover operation is such that the operative portion 30*a* or 130*a* of the knockover plate 30 or 130 is caused to press the fabric 50 from the back side of the tooth members 4*a*. In another embodiment, as illustrated in FIGS. 14–17, there is provided a fabric catch plate 330 as supplementary casting-off means, said plate 330 being adapted to hold the fabric 50 in cooperation with the knockover plate 230. In operation, the knockover plate 230 is moved forward when the set-up comb 4 has reached its lowered position so that the fabric 50 may be grasped between the knockover plate 230 and the catch plate 330.

In this embodiment, drive means for lowering support means for the plates 230 and 330, or drive means for up and down movement of the set-up means may be employed also for the purpose of displacing the set-up comb 4 slightly upward to change the position of its tooth ends relative to the operative portion 230*a* of the knockover plate 230.

Several embodiments of the present invention have been described. As can be understood from the above description, the set-up comb of the set-up means in accordance with the invention is up-and-down movable and its tooth ends are hook-shaped; therefore, at the elevated position the tooth ends extend beyond the gap between the needle beds and can readily hook up the set-up course loops, thus facilitating knitting operation. When the set-up comb reaches the lowered position, accompanied by the hooked-up fabric, on the back side of tooth-end hooks of the comb there are located a displaceable knockover plate and drive means for displacement thereof. When displaced to the advanced position, the knockover plate can have its operative portion press the fabric from the back side of the tooth-end hooks. To either or both or the knockover plate and the set-up comb there are connected drive means for slifhtly moving them upward or downward to change the relative positions of the knockover plate's operative portion in such fabric pushing action and the set-up comb's tooth ends in engagement with the fabric to facilitate knockover operation. Thus, release of the fabric from the set-up comb can be accomplished by means of simple mechanisms adapted for changing the relative positions. Said mechanisms can easily be automated by incorporating means for detecting the varying positions of the set-up comb during its up and down movement.

Since the set-up means according to the invention are adapted to perform set-up operation by hooked up all loops of the set-up course by means of the set-up comb, it is not required to provide a large number of waste courses between the final course of a fabric and the set-up course of the next fabric as is usually required with conventional apparatus, if the knit width of the final course is smaller than that of the set-up course in the case of batch-basis fashioning. According to the invention, it is possible to obtain a uniform knit construction, even if a fabric is fashioned in succession to the prior fabric and without provision of waste courses.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore to be embraced therein.

What is claimed is:

1. Set-up means in a flat knitting machine having a pair of needle beds arranged in an inverted V shape comprising: a set-up comb having a plurality of tooth members, each shaped like a hook at the upper end thereof, said set-up comb being up and down movably disposed beneath a gap between the needle beds so that the upper ends of said tooth members extend beyond said gap when the set-up comb is elevated to the upper extreme, drive means for up-and-down movement of said set-up comb, a knockover plate disposed under the needle beds and supported between side frames of the machine and on the back side of said tooth-end hooks of the set-up comb, said knockover plate having an operative portion displaceable between a retreated position at which said plate may not interfere with the up-and-down movement of said set-up comb and an advanced position at which said plate is able to press the knitted fabric engaged by said set-up comb at its lowered position from the back side of the tooth-end hooks of said comb, drive means for displacing said operative portion of said knockover plate and a pair of guide means projecting from the underside of the pair of needle beds at front portions thereof so that said tooth members may be guided and supported in position within said gap between the needle beds as they pass therethrough, said guide means comprising extensions to the lower ends of a plurality of knockover-comb plate members constituting a knockover comb and fixed to each of the needle beds at the front end portion thereof, said extensions each extending to the underside of the needle beds, a pin extending through each set of said knockover-comb plate members via holes formed in said plate members at the lower ends thereof, and a plurality of rollers rotatably arranged on said pin between said individual knockover-comb plate members, whereby when said set-up comb is at its elevated position, the base portion thereof on which the tooth members are arranged is up and down movably supported by and between said pair of guide means.

2. Set-up means as set forth in claim 1, including fabric take-up means arranged beneath the needle beds and consisting essentially of a take-up roller and a counter roller disposed in opposed relation thereto, means to allow the tooth ends of said set-up comb to move up and down for passing between said take-up roller and said counter roller, and wherein said knockover plate is disposed under said fabric take-up means.

3. Set-up means as set forth in claim 1, wherein said knockover plate is pivotally supported on a block which is disposed adjacent the lowered position of the set-up comb and on the back side of the tooth-end hooks of said comb and which is pivotally connected to the side frames, spring means suitably disposed between the knockover plate and the block for constantly urging said operative portion of the knockover plate in the forward direction relative to the lower free end of said block, the urging force on said operative portion being controlled by suitable lock means provided between said operative portion and the block so that said operative portion may be stopped at a predetermined position when it is displaced in the forward direction, and drive means connected to said block for displacing said operative portion of said knockover plate between an advanced position at which said operative portion is able to press the fabric engaged by said set-up comb at its lowered position and a retreated position at which said operative portion will not act thereon.

4. Set-up means as set forth in claim 1, including a fabric catch plate in opposed relation to said knockover plate for grasping the fabric engaged by said set-up comb at its lowered position in cooperation with the knockover plate brought to its advanced position.

5. Set-up means as set forth in claim 1, wherein said knockover plate is pivotally supported between the side frames through a bracket, with its pivot point located on the rear side of and at a level lower than the tooth-end hooks of said set-up comb at the lowered position thereof, and wherein said drive means for displacing the operative portion of said knockover plate between the retreated position at which said operative portion will not interfere with up-and-down movement of said set-up comb and the advanced position at which said operative portion is able to press the fabric engaged by said set-up comb at its lowered position from the back side of the tooth-end hooks of said comb are drive means connected to the knockover plate for pivotally displacing said plate, and a drive means for displacing the tooth ends of the set-up comb at its lowered position slightly upward relative to the operative portion of the knockover plate at its advanced position.

* * * * *